US009448508B2

(12) United States Patent
Yamane et al.

(10) Patent No.: US 9,448,508 B2
(45) Date of Patent: Sep. 20, 2016

(54) DEVELOPMENT DEVICE AND IMAGE FORMING APPARATUS INCLUDING THE SAME

(71) Applicant: KYOCERA DOCUMENT SOLUTIONS INC., Osaka (JP)

(72) Inventors: Naoki Yamane, Osaka (JP); Lin Lu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/102,242

(22) Filed: Dec. 10, 2013

(65) Prior Publication Data

US 2014/0161490 A1 Jun. 12, 2014

(30) Foreign Application Priority Data

Dec. 12, 2012 (JP) ..... 2012-270973

(51) Int. Cl.
*G03G 15/08* (2006.01)

(52) U.S. Cl.
CPC ..... *G03G 15/0887* (2013.01); *G03G 15/0893* (2013.01)

(58) Field of Classification Search
CPC ..... G03G 15/0887; G03G 15/0893; G03G 15/0844; G03G 2215/0838
USPC ..... 399/257
See application file for complete search history.

(56) References Cited

U.S. PATENT DOCUMENTS 5,440,376 A 8/1995 Hagihara
8,818,245 B2 8/2014 Takaya et al.
2009/0074466 A1* 3/2009 Kwon et al. ..... 399/252
2011/0229209 A1* 9/2011 Takaya et al. ..... 399/257
2012/0076545 A1* 3/2012 Rapkin et al. ..... 399/256

FOREIGN PATENT DOCUMENTS

JP H02-226268 A 9/1990
JP H05-289506 A 11/1993

(Continued)

OTHER PUBLICATIONS

An Office Action; "Notice of Reasons for Rejection," issued by the Japanese Patent Office on Feb. 10, 2015, which corresponds to Japanese Patent Application No. 2012-270973 and is related to U.S. Appl. No. 14/102,242.

*Primary Examiner* — David Gray
*Assistant Examiner* — Thomas Giampaolo, II
(74) *Attorney, Agent, or Firm* — Studebaker & Brackett PC

(57) ABSTRACT

A development device includes a developer container, a developer bearing member, a mixing/transporting member, an opening/closing member, and a drive mechanism. The developer container contains a developer. The developer bearing member is rotatably supported by the developer container. The developer bearing member also has a surface facing an image bearing member on which an electrostatic latent image is to be formed. The developer is borne on the surface of the developer bearing member. The mixing/transporting member mixes and transports the developer in the developer container. The opening/closing member opens and closes a developer outlet for discharging an excess of the developer in the developer container. The drive mechanism drives the opening/closing member in association with driving of the developer bearing member or the mixing/transporting member to open the developer outlet.

10 Claims, 8 Drawing Sheets

(56) References Cited

FOREIGN PATENT DOCUMENTS

| | | | |
|---|---|---|---|
| JP | H06-222633 | A | 8/1994 |
| JP | 2007-033621 | A | 2/2007 |
| JP | 2010-025987 | A | 2/2010 |
| JP | 2011-197442 | A | 10/2011 |

* cited by examiner

DEVELOPMENT DEVICE AND IMAGE FORMING APPARATUS INCLUDING THE SAME

INCORPORATION BY REFERENCE

The present application claims priority under 35 U.S.C. §119 to Japanese Patent Application No. 2012-270973, filed Dec. 12, 2012. The contents of this application are incorporated herein by reference in their entirety.

BACKGROUND

The present disclosure relates to development devices and image forming apparatuses including a development device.

In such image forming apparatuses, a latent image is formed on a surface of an image bearing member including a photosensitive member etc., and the latent image is developed into a visible toner image by the development device. The development is performed, for example, by the two-component development technique, which uses a two-component developer. The development device which is employed in the two-component development technique includes a developer container, a development roller, and a mixing/transporting member. The developer container stores a two-component developer containing magnetic carrier particles and toner particles. The development roller supplies the developer to the image bearing member. The mixing/transporting member transports the developer in the developer container while mixing the developer, to supply the developer to the development roller.

In the development device employed in the two-component development technique, the toner is consumed during development. On the other hand, the carrier particles are circulated in the development device without being consumed. Therefore, the carrier particles deteriorate over time in the development device. As a result, the toner charging performance of the carrier particles gradually becomes lower.

Therefore, some techniques of reducing or preventing the deterioration in the charging performance of the carrier particles have been proposed. For example, in order to reduce or prevent the deterioration in the charging performance, a development device is configured so that a new supply of the carrier-containing developer is added to the developer container, and some excess developer is discharged from the developer container. In such a development device, a developer outlet is formed on the developer container. The developer outlet is an opening through which the developer is discharged.

Incidentally, when the development device is initially driven, damage to the development device is likely to occur due to friction between its members, such as the development roller etc. In order to reduce or prevent the occurrence of the damage, the development device is previously loaded with the developer. The amount of the developer previously loaded is set to such a value that a layer of toner can be formed on the development roller.

Therefore, when the development device with the developer outlet is transported with it being mounted in the body of an image forming apparatus or with it being packed separately from the body of an image forming apparatus, the developer loaded in the development device is likely to leak through the developer outlet and scatter due to vibration, shock, etc. during transportation. The scattering developer contaminates the inside of the image forming apparatus, for example.

SUMMARY

A development device according to an example of the present disclosure includes a developer container, a developer bearing member, a mixing/transporting member, an opening/closing member, and a drive mechanism. The developer container contains a developer. The developer bearing member is rotatably supported by the developer container. The developer bearing member also has a surface facing an image bearing member on which an electrostatic latent image is to be formed. The developer is borne on the surface of the developer bearing member. The mixing/transporting member mixes and transports the developer in the developer container. The opening/closing member opens and closes a developer outlet for discharging an excess of the developer in the developer container. The drive mechanism drives the opening/closing member in association with driving of the developer bearing member or the mixing/transporting member to open the developer outlet.

DETAILED DESCRIPTION

Figure 1:
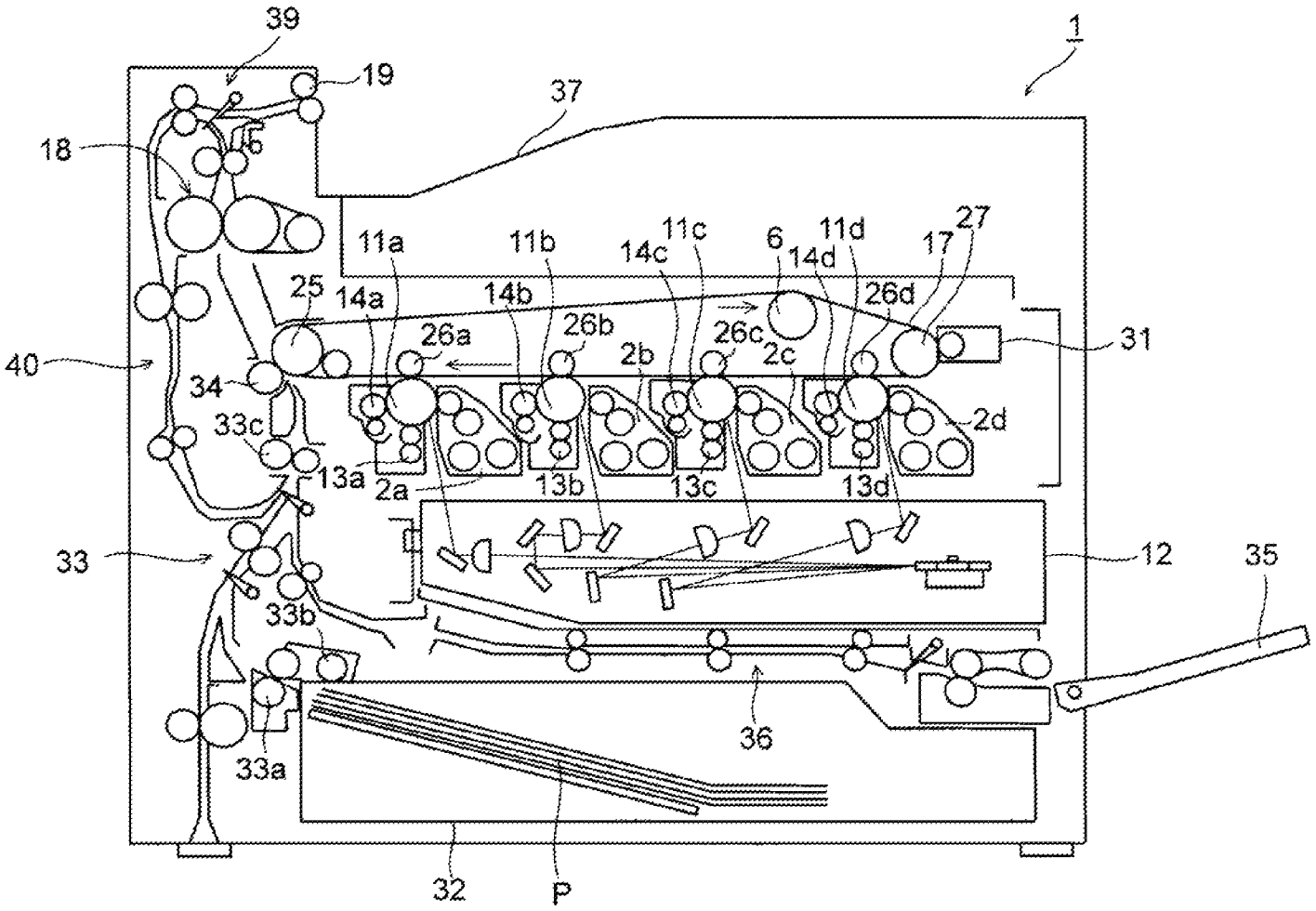
FIG. 1 is a cross-sectional view schematically showing an overall configuration of an image forming apparatus according to one embodiment of the present disclosure.

An embodiment of the present disclosure will now be specifically described with reference to the accompanying drawings. Note that the same reference characters designate the same or corresponding parts throughout the several views, and will not be redundantly described.

A structure of an image forming apparatus 1 according to one embodiment of the present disclosure will be described with reference to FIG. 1. FIG. 1 is a cross-sectional view schematically showing an overall configuration of the image forming apparatus 1 of this embodiment.

The image forming apparatus 1 is a tandem color printer. The image forming apparatus 1 includes photosensitive drums (image bearing members) 11*a*-11*d* which are rotatable. The photosensitive drums 11*a*-11*d* may each be an organic photosensitive member (OPC photosensitive member) including an organic photosensitive layer, an amorphous silicon photosensitive member including an amorphous silicon photosensitive layer, etc. The photosensitive drums 11*a*-11*d* are arranged, corresponding to magenta, cyan, yellow, and black, respectively. Development devices 2*a*-2*d*, an exposure unit 12, chargers 13*a*-13*d*, and cleaning devices 14*a*-14*d* are provided around the photosensitive drums 11*a*-11*d*.

The development devices 2*a*-2*d* are arranged to the right of the photosensitive drums 11*a*-11*d*, facing the photosensitive drums 11*a*-11*d*, and supply toner to the photosensitive drums 11*a*-11*d*. As used herein, the terms "right" and "left" refer to directions in the drawings to which reference is made. The chargers 13*a*-13*d* are arranged upstream of the development devices 2*a*-2*d* in the rotational direction of the photosensitive drums 11*a*-11*d*, facing surfaces of the photosensitive drums 11*a*-11*d*. The chargers 13*a*-13*d* uniformly charge the surfaces of the photosensitive drums 11*a*-11*d*.

The exposure unit 12 is provided below the development devices 2*a*-2*d*. The exposure unit 12 exposes each of the photosensitive drums 11*a*-11*d* to light in a scanning manner based on image data of characters, graphics, etc. input to an image input unit (not shown) from a personal computer etc. As used herein, the terms "below" and "above" refer to directions in the drawings to which reference is made. The exposure unit 12 includes laser light sources and a polygon mirror. The exposure unit 12 includes at least one reflecting mirror and a lens for each of the photosensitive drums 11*a*-11*d*. Laser light emitted from the laser light sources is brought from downstream of the chargers 13*a*-13*d* in the rotational direction of the photosensitive drums 11*a*-11*d*, each via the polygon mirror, the at least one reflecting mirror, and the lens, to the surfaces of the photosensitive drums 11*a*-11*d*. The laser light thus brought allows an electrostatic latent image to be formed on the surface of each of the photosensitive drums 11*a*-11*d*. These electrostatic latent images are developed to toner images by the development devices 2*a*-2*d*.

An intermediate transfer belt 17 which is an endless loop is supported by a tension roller 6, a drive roller 25, and an idler roller 27 with tension being exerted on the intermediate transfer belt 17. The drive roller 25 is driven by a motor (not shown) to rotate. The intermediate transfer belt 17 is driven by the rotation of the drive roller 25 to circulate.

The photosensitive drums 11*a*-11*d* are arranged below the intermediate transfer belt 17 to be in contact with the intermediate transfer belt 17 and adjacent to each other along a conveyance direction (a direction indicated by an arrow in FIG. 1). Primary transfer rollers 26*a*-26*d* face the photosensitive drums 11*a*-11*d*, respectively, with the intermediate transfer belt 17 being interposed therebetween. The primary transfer rollers 26*a*-26*d*, which are pressed against the intermediate transfer belt 17, form a primary transfer portion with the photosensitive drums 11*a*-11*d*. In the primary transfer portion, the toner images are transferred to the intermediate transfer belt 17. Specifically, while the intermediate transfer belt 17 is rotated, the toner images of the photosensitive drums 11*a*-11*d* are sequentially transferred to the intermediate transfer belt 17 at predetermined timings. As a result, a full-color toner image is formed on a surface of the intermediate transfer belt 17. The full-color toner image is a superimposition of the toner images of the four colors, i.e., magenta, cyan, yellow, and black.

A secondary transfer roller 34 faces the drive roller 25 with the intermediate transfer belt 17 being interposed therebetween. The secondary transfer roller 34, which is pressed against the intermediate transfer belt 17, forms a secondary transfer portion with the drive roller 25. In the secondary transfer portion, the toner image on the surface of the intermediate transfer belt 17 is transferred to paper P. After the transfer of the toner image, a belt cleaning device 31 removes residual toner from the intermediate transfer belt 17.

A paper feed cassette 32 is provided at a lower position in the image forming apparatus 1. A stack tray 35 is provided to the right of the paper feed cassette 32. The paper feed cassette 32 accommodates the paper P. The stack tray 35 supplies paper that is manually fed. A first paper conveyance path 33 is provided to the left of the paper feed cassette 32. The first paper conveyance path 33 conveys the paper P fed from the paper feed cassette 32 to the secondary transfer portion of the intermediate transfer belt 17. A second paper conveyance path 36 is provided to the left of the stack tray 35. The second paper conveyance path 36 conveys paper fed from the stack tray 35 to the secondary transfer portion. A fixing unit 18 and a third paper conveyance path 39 are provided at an upper left position in the image forming apparatus 1. The fixing unit 18 performs a fixing process on the paper P on which an image has been formed. The third paper conveyance path 39 conveys to the paper output unit 37 the paper P on which the fixing process has been performed.

The paper feed cassette 32 can be pulled out of the body of the image forming apparatus 1 (toward the viewer of FIG. 1). As a result, a new supply of paper P can be added to the paper feed cassette 32. The paper P accommodated in the paper feed cassette 32 is fed to the first paper conveyance path 33 by a pickup roller 33*b* and a stacking roller 33*a*, one sheet at a time.

The first paper conveyance path 33 and the second paper conveyance path 36 converge before a registration roller pair 33*c*. The registration roller pair 33*c* conveys the paper P to the secondary transfer portion. The registration roller pair 33*c* adjusts the timing of a paper feed operation to the secondary transfer portion in relation to an image formation operation of the intermediate transfer belt 17. The full-color toner image on the intermediate transfer belt 17 is transferred (secondary transfer) to the paper P conveyed to the secondary transfer portion by the secondary transfer roller 34 to which a bias potential is applied. The paper P with the transferred full-color toner image is conveyed to the fixing unit 18.

The fixing unit 18 includes a fixing belt, a fixing roller, a pressure roller, etc. The fixing belt is heated by a heater. The fixing roller is in contact with the inner surface of the fixing belt. The pressure roller is pressed against the fixing roller with the fixing belt being interposed therebetween. The fixing unit 18 heats and presses the paper P with the transferred toner image. Thus, the fixing process is performed. After the toner image is fixed to the paper P by the fixing unit 18, the paper P is optionally reversed in a fourth paper conveyance path 40. As a result, a toner image is transferred (secondary transfer) to the back side of the paper P by the secondary transfer roller 34, and is then fixed by the fixing unit 18. The paper P with the fixed toner image is passed through the third paper conveyance path 39, and is then discharged to the paper output unit 37 by a discharge roller pair 19.

Figure 2:
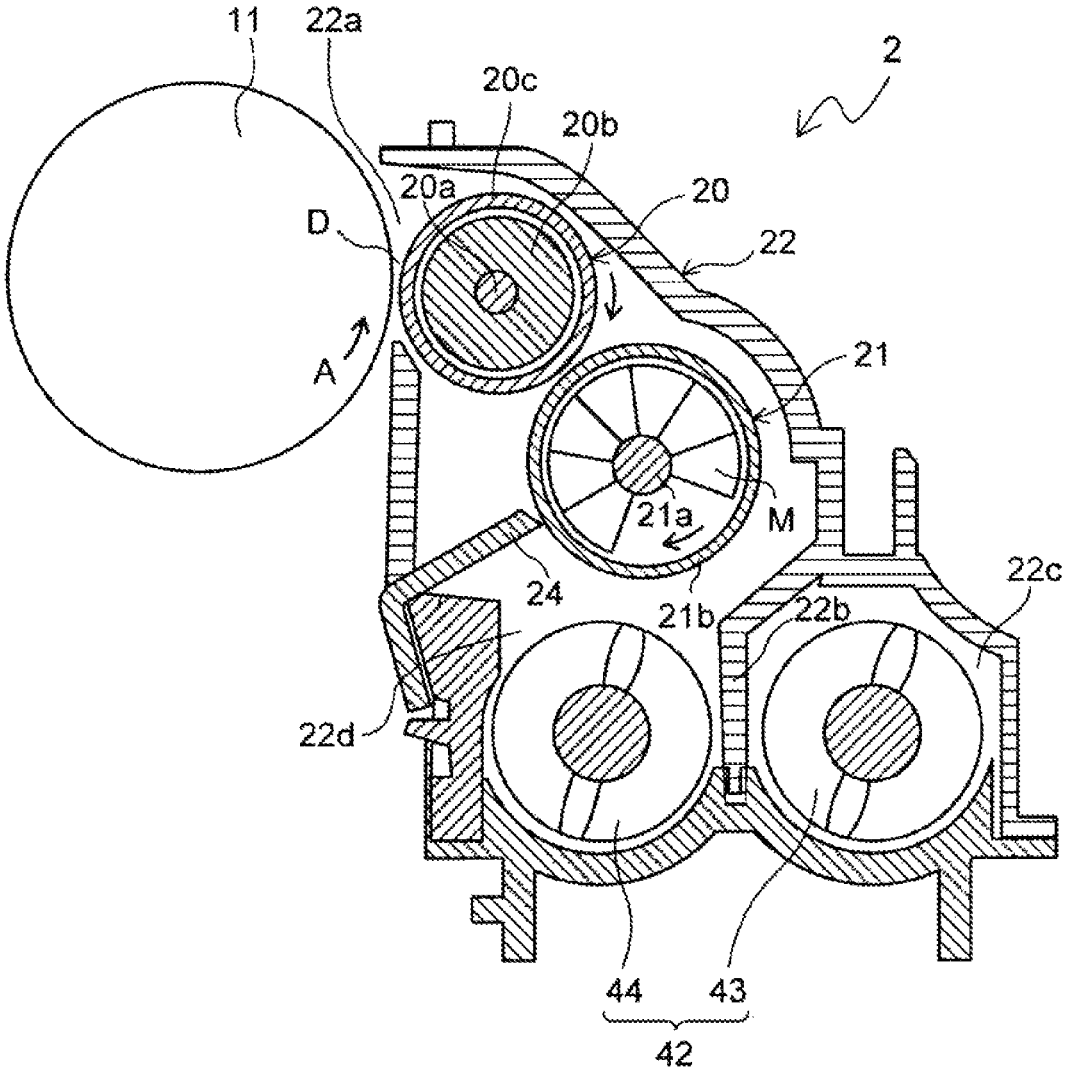
FIG. 2 is a cross-sectional side view showing a structure of a development device according to one embodiment of the present disclosure.

Next, a detailed structure of the development device 2*a* will be described with reference to FIG. 2. FIG. 2 is a cross-sectional side view showing a structure of a development device 2 (2*a*). In the description that follows, a structure and an operation of the development device 2*a* in relation to the photosensitive drum 11*a* of FIG. 1 will be described. Structures and operations of the development devices 2*b*-2*d* are similar to those of the development device 2*a* and will not be described. Also in the description that follows, the reference characters a-d indicating the different colors of the development devices and the photosensitive members are removed.

As shown in FIG. 2, the development device 2 includes a development roller (developer bearing member) 20, a magnetic roller 21, a regulating blade 24, a mixing/transporting member 42, a developer container 22, etc.

The developer container 22 forms an outer shell of the development device 2. A lower internal portion of the developer container 22 is partitioned into a first transport chamber 22*c* and a second transport chamber 22*d* by a partitioning portion 22*b*. The first and second transport chambers 22*c* and 22*d* accommodate a developer containing carrier particles and toner particles. The mixing/transporting member 42, the magnetic roller 21, and the development roller 20 are rotatably held by the developer container 22. The developer container 22 has an opening 22*a*. The development roller 20 is exposed through the opening 22*a* to the photosensitive drum 11.

The development roller 20 is arranged to the right of the photosensitive drum 11, facing the photosensitive drum 11. There is a predetermined gap between the development roller 20 and the photosensitive drum 11. The development roller 20 forms a development region D for supplying toner to the photosensitive drum 11. The development region D is formed at a position where the development roller 20 is close to the photosensitive drum 11. The magnetic roller 21 is arranged diagonally below and to the right of the development roller 20, facing the development roller 20. There is a predetermined gap between the magnetic roller 21 and the development roller 20. Toner is supplied from the magnetic roller 21 to the development roller 20 at a position where the magnetic roller 21 is close to the development roller 20. The mixing/transporting member 42 is arranged generally below the magnetic roller 21. The regulating blade 24 is arranged diagonally below and to the left of the magnetic roller 21 and is held by the developer container 22.

The mixing/transporting member 42 includes two spirals, i.e., a first spiral 43 and a second spiral 44. The second spiral 44 is provided in the second transport chamber 22*d* below the magnetic roller 21. The first spiral 43 is provided in the first transport chamber 22*c* and is right-adjacent to the second spiral 44.

The first and second spirals 43 and 44 mix the developer so that the toner in the developer is charged to a predetermined potential level. As a result, the toner is held by the carrier particles. A communication portion (an upstream communication portion 22*e* and a downstream communication portion 22*f* described below) is provided at both end portions in the longitudinal direction (a direction perpendicular to the drawing sheet of FIG. 2) of the partitioning portion 22*b* partitioning the first transport chamber 22*c* from the second transport chamber 22*d*. These communication portions allow the charged developer to circulate through the first and second transport chambers 22*c* and 22*d* when the first and second spirals 43 and 44 are rotated. The developer is also supplied from the second spiral 44 to the magnetic roller 21.

The magnetic roller 21 includes a roller shaft 21*a*, a magnetic pole member M, and a non-magnetic sleeve 21*b* of a non-magnetic material. The magnetic roller 21 bears the developer supplied from the mixing/transporting member 42, and supplies only toner from the borne developer to the development roller 20. The magnetic pole member M includes a plurality of magnets. Each magnet has a cross-sectional shape of a sector. An outer circumferential portion of the magnetic pole member M is formed by outer circumferential portions of the magnets (outer circumferential portions (outer arc portions) of the sectors). Specifically, at the outer circumferential portion of the magnetic pole member M, the outer circumferential portions of the magnets having different polarities are alternately arranged. Inner circumferential portions of the magnets (inner circumferential portions (inner arc portions) of the sectors) are fixed to the roller shaft 21*a* by adhesion etc. In the non-magnetic sleeve 21*b*, the roller shaft 21*a* is supported by the developer container 22 and not allowed to rotate, with a predetermined gap being provided between the magnetic pole member M and the non-magnetic sleeve 21*b*. The non-magnetic sleeve 21*b* is rotated in the same direction (the clockwise direction of FIG. 2) as that of the development roller 20 by a drive mechanism including a motor and a gear (not shown). A bias is applied to the non-magnetic sleeve 21*b*. The bias is generated by superimposing an alternating-current voltage on a direct-current voltage. On the surface of the non-magnetic sleeve 21*b*, the magnetic force of the magnetic pole member M causes the charged developer to form a magnetic brush. The magnetic brush is borne on the surface of the non-magnetic sleeve 21*b*. The magnetic brush is adjusted to a predetermined height by the regulating blade 24.

When the non-magnetic sleeve 21*b* is rotated, the magnetic brush is transported to come into contact with the development roller 20. At that time, only toner of the magnetic brush is supplied to the development roller 20 in response to the bias applied to the non-magnetic sleeve 21*b*.

The development roller 20 includes a fixed shaft 20*a*, a magnetic pole member 20*b*, a development sleeve 20, etc. The magnetic pole member 20*b* includes a magnet. The development sleeve 20 is formed of a non-magnetic metal material in the shape of a cylinder.

The fixed shaft 20*a* is supported by the developer container 22 and not allowed to rotate. A development sleeve 20*c* is rotatably held by the fixed shaft 20*a*. The magnetic pole member 20*b* is fixed to the fixed shaft 20*a* by adhesion etc. The development sleeve 20*c* is arranged to face the magnetic roller 21. There is a predetermined gap between the development sleeve 20*c* and the magnetic roller 21. The development sleeve 20*c* is rotated in a direction indicated by an arrow in FIG. 2 (a clockwise direction) by a drive mechanism including a motor and a gear (not shown). A development bias is applied to the development sleeve 20*c*. The development bias is generated by superimposing an alternating-current voltage on a direct current voltage.

When the development sleeve 20*c* to which the development bias is applied is rotated in the clockwise direction of FIG. 2, the toner borne on the surface of the development sleeve 20*c* is caused to fly toward the photosensitive drum 11, in the development region D, due to a difference between the electrical potential of the development bias and the electrical potential of an exposed portion of the photosensitive drum 11. The flying toner successively adheres to the exposed portion of the photosensitive drum 11 rotating in a direction indicated by an arrow A (a counterclockwise direction). As a result, the electrostatic latent image formed on the photosensitive drum 11 is developed.

Figure 3:
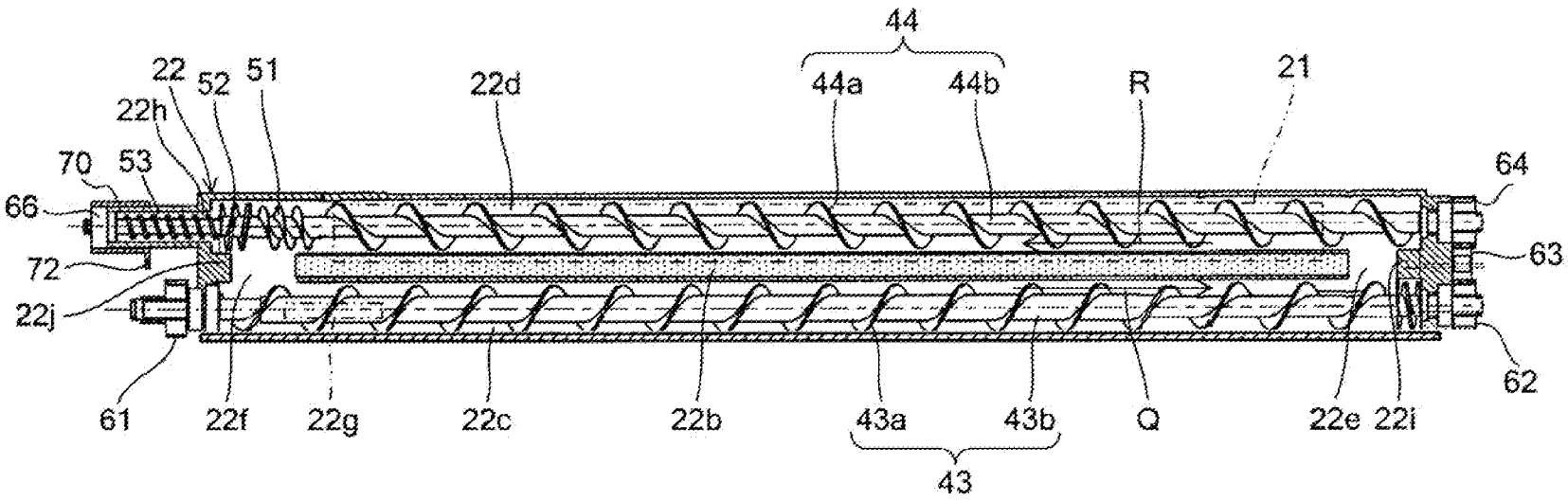
FIG. 3 is a cross-sectional plan view showing a structure of a lower portion of the development device of the embodiment of the present disclosure.
Figure 4:
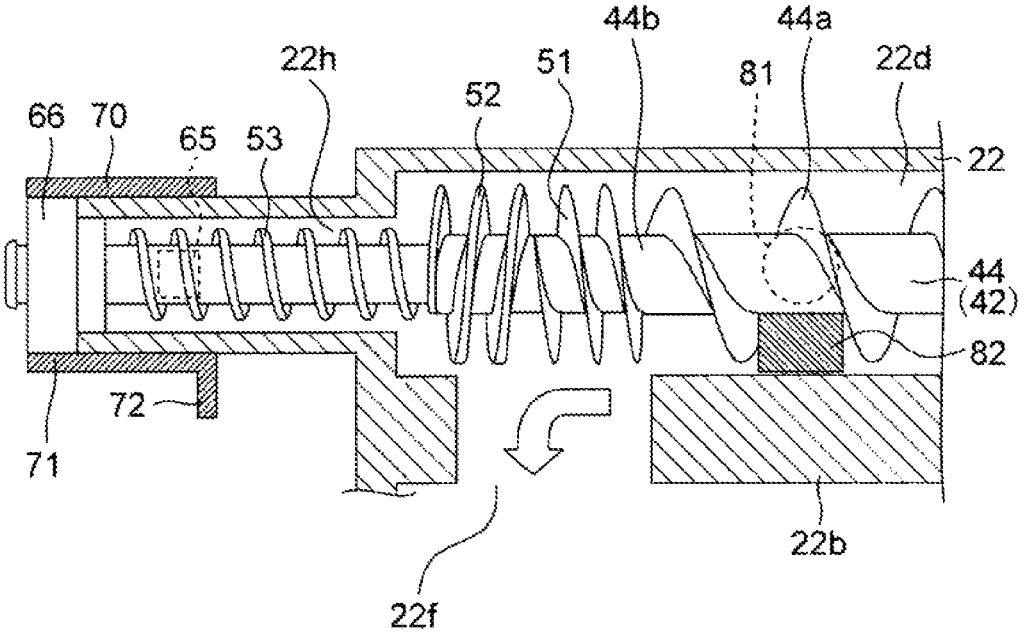
FIG. 4 is a cross-sectional plan view showing a structure in the vicinity of a developer discharge portion of the development device of the embodiment of the present disclosure.
Figure 5:
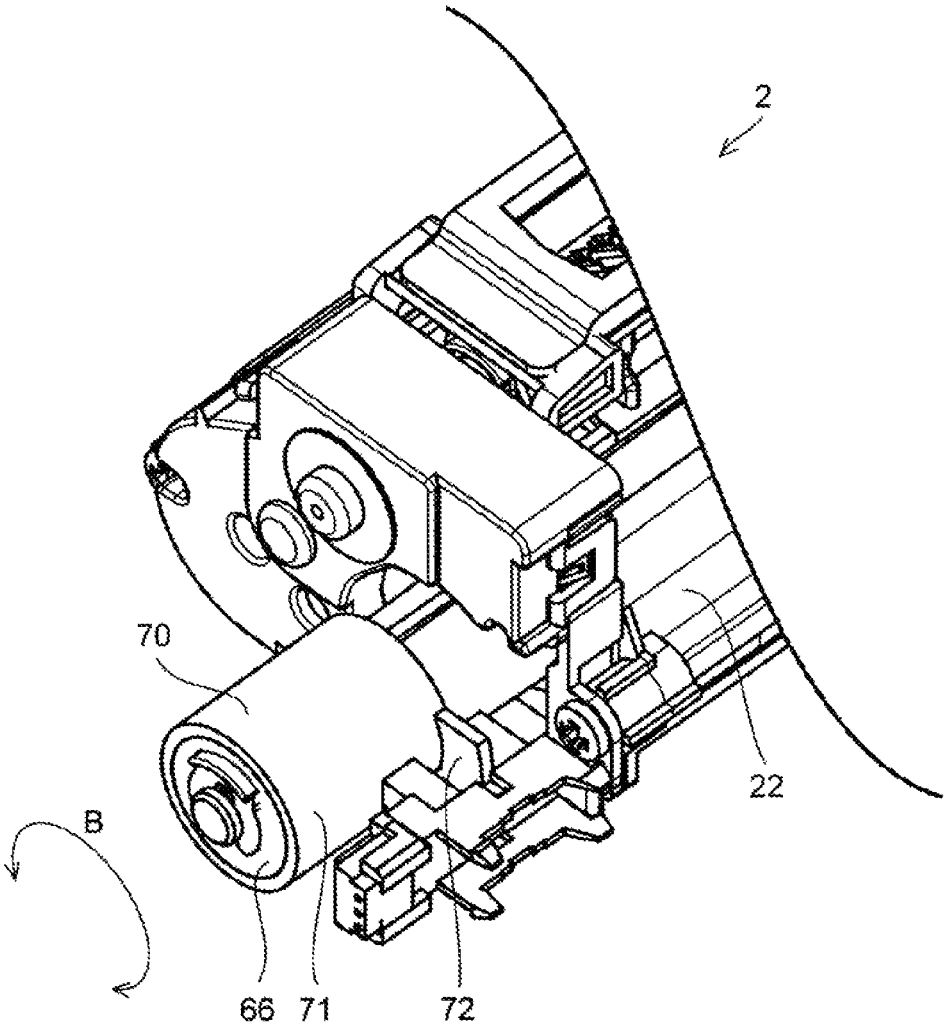
FIG. 5 is a perspective view showing a structure in the vicinity of a shutter of the development device of the embodiment of the present disclosure.
Figure 6:
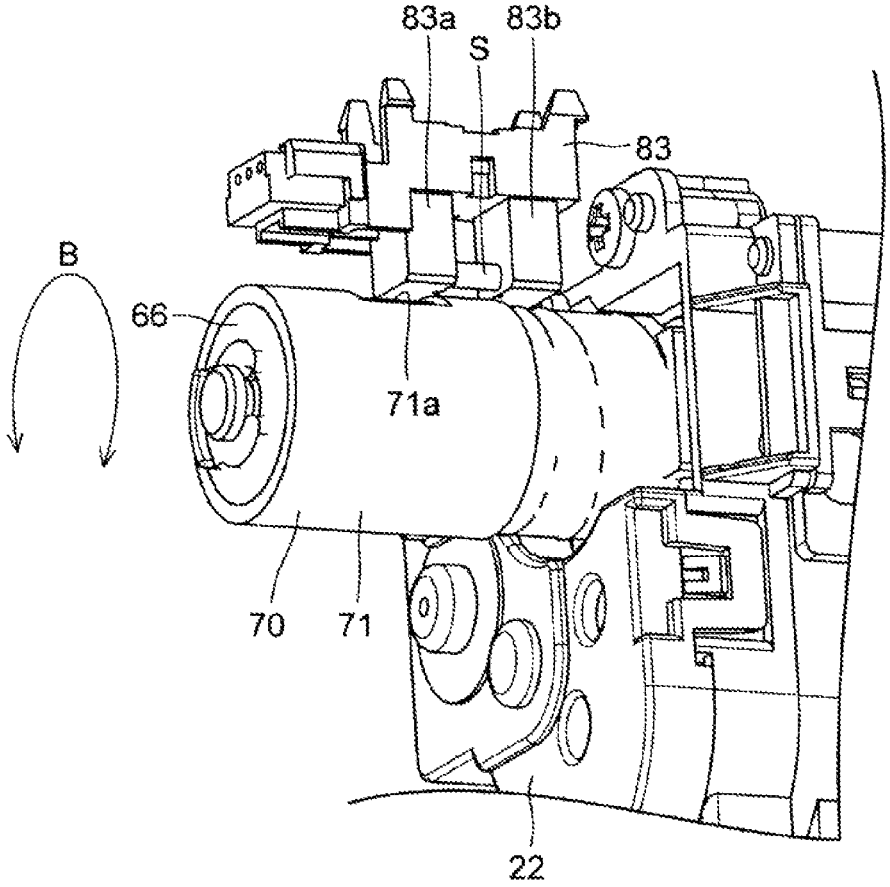
FIG. 6 is a perspective view showing an outlet in the closed state of the development device of the embodiment of the present disclosure as viewed from below.
Figure 7:
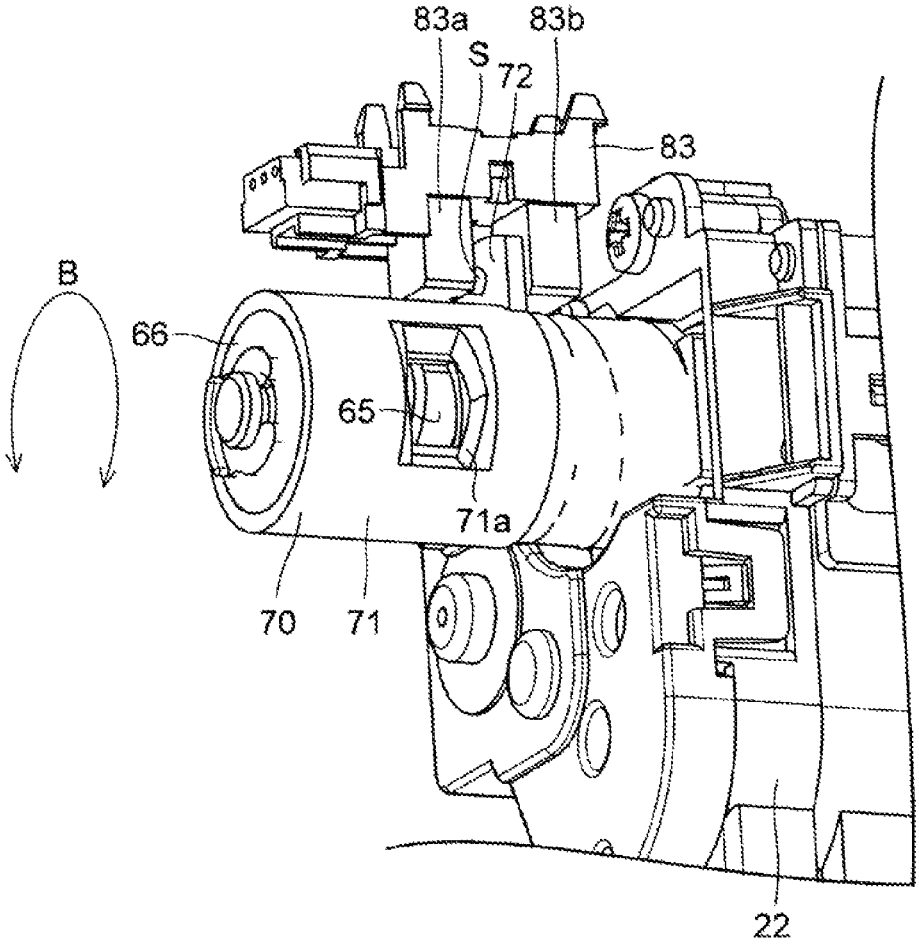
FIG. 7 is a perspective view showing the outlet in the open state of the development device of the embodiment of the present disclosure as viewed from below.
Figure 8:
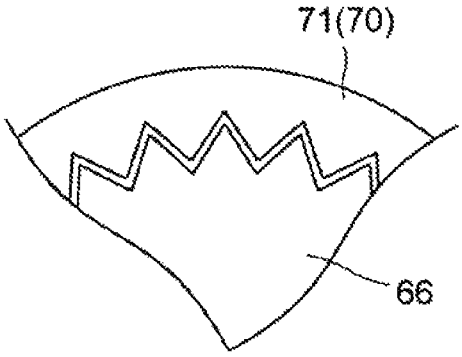
FIG. 8 is a cross-sectional view showing structures of the shutter and a drive gear of the development device of the embodiment of the present disclosure.

Next, a mixing portion of the development device 2 will be described in detail with reference to FIGS. 3-8. FIG. 3 is a cross-sectional plan view showing a structure of a lower portion of the development device 2. FIG. 4 is a cross-sectional plan view showing a structure in the vicinity of a developer discharge portion of the development device 2. FIG. 5 is a perspective view showing a structure in the vicinity of a shutter of the development device 2. FIG. 6 is a perspective view showing an outlet in the closed state of the development device 2 as viewed from below. FIG. 7 is a perspective view showing the outlet in the open state of the development device 2 as viewed from below. FIG. 8 is a cross-sectional view showing structures of the shutter and a drive gear of the development device 2.

As shown in FIG. 3, the developer container 22 includes, as described above, the first transport chamber 22*c*, the second transport chamber 22*d*, the partitioning portion 22*b*, the upstream communication portion 22*e*, and the downstream communication portion 22*f*. In addition, the developer container 22 includes a developer replenishment opening 22*g*, a developer discharge portion 22*h*, an upstream sidewall portion 22*i*, and a downstream sidewall portion 22*j*. In the first transport chamber 22*c*, the left side of FIG. 3 is the upstream side thereof, and the right side of FIG. 3 is the downstream side thereof. On the other hand, in the second transport chamber 22*d*, the right side of FIG. 3 is the upstream side thereof, and the left side of FIG. 3 is the downstream side thereof. Therefore, the communication portions and the sidewall portions are each designated by "upstream" or "downstream" with reference to the second transport chamber 22*d*.

The partitioning portion 22*b* extends in the longitudinal direction of the developer container 22 to partition the first transport chamber 22*c* from the second transport chamber 22*d* so that the first and second transport chambers 22*c* and 22*d* are arranged in parallel to each other. A right end portion of the partitioning portion 22*b* and an inner wall portion of the upstream sidewall portion 22*i* form the upstream communication portion 22*e*. On the other hand, a left end portion of the partitioning portion 22*b* and an inner wall portion of the downstream sidewall portion 22*j* form the downstream communication portion 22*f*. The developer is allowed to circulate through the first transport chamber 22*c*, the upstream communication portion 22*e*, the second transport chamber 22*d*, and the downstream communication portion 22*f*.

The developer replenishment opening 22*g* is used to add a new supply of toner particles and carrier particles from a developer replenishment container (not shown) to the developer container 22. The developer replenishment container is provided above the developer container 22. The developer replenishment opening 22*g* is formed on an upper portion on an upstream side (a left side of FIG. 3) of the first transport chamber 22*c*.

The developer discharge portion 22*h* is used to discharge some excess developer which occurs due to the replenishment of the developer in the first and second transport chambers 22*c* and 22*d*. The developer discharge portion 22*h* is a cylindrical pipe-like transport path. The developer discharge portion 22*h* is provided downstream of and contiguous to the second transport chamber 22*d* in the longitudinal direction of the second transport chamber 22*d*.

The first spiral 43 is provided in the first transport chamber 22*c*, and the second spiral 44 is provided in the second transport chamber 22*d*.

The first spiral 43 has a rotating shaft 43*b* and a first helical blade 43*a*. The first helical blade 43*a* is integrated with the rotating shaft 43*b*. The first helical blade 43*a* is in the shape of a helix extending in the axial direction of the rotating shaft 43*b* with a constant pitch. The first helical blade 43*a* extends to both end portions in the longitudinal direction of the first transport chamber 22*c*. The first helical blade 43*a* partially faces the upstream and downstream communication portions 22*e* and 22*f*. The rotating shaft 43*b* is rotatably supported by the upstream sidewall portion 22*i* and the downstream sidewall portion 22*j* of the developer container 22.

The second spiral 44 has a rotating shaft 44*b* and a second helical blade 44*a*. The second helical blade 44*a* is integrated with the rotating shaft 44*b*. The second helical blade 44*a* is in the shape of a helix extending in the axial direction of the rotating shaft 44*b* with the same pitch as that of the first helical blade 43*a*. The second helical blade 44*a* has a handedness opposite to that of the first helical blade 43*a*. The second helical blade 44*a* also has a length which is greater than or equal to that of the magnetic roller 21 in the axial direction of the magnetic roller 21. The second helical blade 44*a* partially faces the upstream communication portion 22*e*. The rotating shaft 44*b* and the rotating shaft 43*b* are arranged in parallel to each other. The rotating shaft 44*b* is rotatably supported by the upstream sidewall portion 22*i* and the downstream sidewall portion 22*j* of the developer container 22.

In addition to the second helical blade 44*a*, the rotating shaft 44*b* is integrated with a deceleration transport portion 51, a regulation portion 52, and a discharge blade 53.

The deceleration transport portion 51 includes a helical blade having the same handedness as that of the second helical blade 44*a*. The helical blade of the deceleration transport portion 51 has the same outer diameter as that of the second helical blade 44*a*. The helical blade of the deceleration transport portion 51 has a smaller pitch than that of the second helical blade 44*a*. The pitch of the helical blade of the deceleration transport portion 51 is ⅙-⅓ of the pitch of the second helical blade 44*a*. The helical blade of the deceleration transport portion 51 faces the downstream communication portion 22*f*. Note that the helical blade of the deceleration transport portion 51 may not completely face the entire width of the opening of the downstream communication portion 22*f*. In this case, a portion of the helical blade closer to the regulation portion 52 preferably faces the opening of the downstream communication portion 22*f*.

The regulation portion 52 blocks the developer transported to a downstream portion of the second transport chamber 22*d*, and transports the developer in excess of a predetermined amount to the developer discharge portion 22*h*. The regulation portion 52 includes a helical blade provided on the rotating shaft 44*b*. The helical blade of the regulation portion 52 has a handedness opposite to that of the second helical blade 44*a*. The helical blade of the regulation portion 52 has substantially the same outer diameter as that of the second helical blade 44*a*. The helical blade of the regulation portion 52 has a smaller pitch than that of the second helical blade 44*a*. There is a gap having a predetermined size between inner wall portions (the downstream sidewall portion 22*j*, etc.) of the developer container 22 and an outer circumferential portion of the regulation portion 52. The excess of the developer is discharged through the gap.

The rotating shaft 44*b* extends to the inside of the developer discharge portion 22*h*. The discharge blade 53 is provided on the rotating shaft 44*b* in the developer discharge portion 22*h*. Therefore, when the rotating shaft 44*b* is rotated, the discharge blade 53 is also rotated. The discharge blade 53 includes a helical blade having the same handedness as that of the second helical blade 44*a*. The discharge blade 53 has a smaller pitch than that of the second helical blade 44*a*. The discharge blade 53 has a smaller outer diameter than that of the second helical blade 44*a*. Therefore, when the rotating shaft 44*b* is rotated, the excess developer which has been transported over the regulation portion 52 into the developer discharge portion 22*h* is transported to the left side of FIG. 3, and is then discharged from the developer container 22. The discharge blade 53, the regulation portion 52, the deceleration transport portion 51, and the second helical blade 44*a* may be formed of a synthetic resin and molded integrally with the rotating shaft 44*b*.

An outlet (developer outlet) 65 (see FIG. 4) is formed in a lower portion of an outer circumferential surface of the developer discharge portion 22*h*. The outlet 65 is in communication with a transport pipe (not shown). The transport pipe is used to transport the developer to a collecting container (not shown). A shutter (opening/closing member) 70 is mounted on the outer circumferential surface of the developer discharge portion 22*h*. The shutter 70 opens and closes the outlet 65.

Gears 61-64 are provided on an outer wall of the developer container 22. The gears 61 and 62 are firmly attached to the rotating shaft 43*b*. The gear 64 is firmly attached to the rotating shaft 44*b*. The gear 63 is rotatably held by the developer container 22 and engaged with the gears 62 and 64.

As shown in FIGS. 3 and 4, the second spiral 44 includes the deceleration transport portion 51. Specifically, the deceleration transport portion 51 is provided upstream of the regulation portion 52 in a developer transport direction (a direction indicated by an open arrow in FIG. 4). The deceleration transport portion 51 is also located immediately close to the regulation portion 52, facing the downstream communication portion 22*f*.

When the rotating shaft 44*b* is rotated, the developer is transported at a relatively high rate in a region of the second transport chamber 22*d* where the second helical blade 44*a* is provided. In contrast to this, because the helical blade of the deceleration transport portion 51 has a smaller pitch than that of the second helical blade 44*a*, the transport rate of the developer is decreased in a region of the second transport chamber 22*d* where the deceleration transport portion 51 is provided.

Therefore, during development, when the gear 61 is rotated by a drive source, such as a motor etc., the first helical blade 43*a* is rotated together with the rotating shaft 43*b* to transport the developer in the first transport chamber 22*c* in a direction indicated by an arrow Q. Thereafter, the developer is transported through the upstream communication portion 22*e* into the second transport chamber 22*d*. Moreover, because the second helical blade 44*a* is rotated together with the rotating shaft 44*b* which is rotated in association with the rotating shaft 43*b*, the second helical blade 44*a* transports the developer in the second transport chamber 22*d* in a direction indicated by an arrow R to the deceleration transport portion 51.

The developer is transported at a relatively high rate by the rotation of the first and second helical blades 43*a* and 44*a*. On the other hand, the developer is transported at a relatively low rate in the vicinity of the deceleration transport portion 51. As a result, even if the developer strikes the regulation portion 52, the developer is prevented or substantially prevented from bouncing high. Therefore, during development, the developer is prevented or substantially prevented from being transported over the outer circumferential portion of the regulation portion 52. Therefore, the developer is transported through the downstream communication portion 22*f* to the first transport chamber 22*c*.

Thus, the developer is mixed and supplied to the magnetic roller 21 while being circulated from the first transport chamber 22*c* to the upstream communication portion 22*e*, then to the second transport chamber 22*d*, and then to the downstream communication portion 22*f*.

Next, a case where a new supply of the developer is added through the developer replenishment opening 22*g* will be described. When toner is consumed by development, a new supply of the developer containing carrier particles is add through the developer replenishment opening 22*g* to the first transport chamber 22*c*.

The newly supplied developer is transported by the first helical blade 43*a* in the first transport chamber 22*c* in the direction indicated by the arrow Q in a manner similar to that during development, and thereafter, is transported through the upstream communication portion 22*e* into the second transport chamber 22*d*. Moreover, the developer is transported by the second helical blade 44*a* in the second transport chamber 22*d* in a direction indicated by an arrow R to the deceleration transport portion 51. When the regulation portion 52 is rotated in association with the rotating shaft 44*b*, the regulation portion 52 applies a transport force to the developer in a direction opposite to that in which the second helical blade 44*a* transports the developer. On the other hand, the transport rate of the developer is decreased in the deceleration transport portion 51. As a result, the developer is blocked in the vicinity of the deceleration transport portion 51 located upstream of the regulation portion 52, so that the developer is accumulated high. Thereafter, some excess developer (of which the amount is smaller than that of the new supply of the developer added through the developer replenishment opening 22*g*) is transported over the regulation portion 52, and discharged from the developer container 22 via the developer discharge portion 22*h*.

In the second transport chamber 22*d*, a toner density detecting sensor 81 is provided upstream of and adjacent to the deceleration transport portion 51 in the developer transport direction (the direction indicated by the open arrow in FIG. 4). Note that, in FIG. 4, the second spiral 44 is located closer to the viewer viewing the drawing sheet than the toner density detecting sensor 81, and therefore, the toner density detecting sensor 81 is indicated using a dashed line.

The toner density detecting sensor 81 may be a magnetic permeability sensor. The magnetic permeability sensor detects the magnetic permeability of the developer in the developer container 22. The toner density detecting sensor 81 is configured to output, when detecting the magnetic permeability of the developer, a voltage value corresponding to the result of the detection to a control unit (not shown). The control unit is configured to determine the density of the toner based on the output value of the toner density detecting sensor 81.

The output value of the toner density detecting sensor 81 varies depending on the toner density. As the toner density increases, the ratio of the toner particles to the magnetic carrier particles increases, i.e., the proportion of the toner, which does not allow a magnetic field to be formed therein, increases. Therefore, the output value of the toner density detecting sensor 81 decreases. On the other hand, as the toner density decreases, the ratio of the toner particles to the carrier particles decreases, i.e., the proportion of the carrier particles, which form a magnetic field therein, increases. Therefore, the output value of the toner density detecting sensor 81 increases.

A scraper 82 is provided at a portion of the second spiral 44 which faces the toner density detecting sensor 81. The scraper 82 has, for example, a structure in which a layer of non-woven fabric is provided on a flexible film which is a substrate. The scraper 82 is attached to a scraper supporting portion (not shown) which is formed on the rotating shaft 44*b* of the second spiral 44, and is in parallel to the rotating shaft 44*b*. When the scraper 82 is rotated in association with the rotating shaft 44*b*, the scraper 82 cleans the detection surface of the toner density detecting sensor 81 by rubbing. Moreover, the developer is prevented or substantially prevented from being accumulated in a region where the toner density detecting sensor 81 is provided.

As shown in FIGS. 4 and 5, the shutter 70 is a generally cylindrical member. The shutter 70 is put on the developer discharge portion 22*h* (the developer discharge portion 22*h* is inserted into the shutter 70's cylinder) so that the shutter 70 is allowed to rotate in a circumferential direction (a direction indicated by a reference character "B") about a center axis of the developer discharge portion 22*h* (a center axis of the rotating shaft 44*b* of the second spiral 44). As shown in FIGS. 6 and 7, the shutter 70 includes a cylindrical portion 71 which is allowed to slide along the outer circumferential surface of the developer discharge portion 22*h*. The cylindrical portion 71 has an opening 71*a*. As shown in FIG. 6, the opening 71*a* is oriented in a horizontal direction when the image forming apparatus 1 is shipped (or when the development device 2 packed separately from the body of the image forming apparatus 1 is shipped). Therefore, the shutter 70 closes the outlet 65 (see FIG. 7) of the developer discharge portion 22*h*. On the other hand, during development, as shown in FIG. 7 the opening 71*a* is oriented in a vertically downward direction (towards a lower position) and the shutter 70 opens the outlet 65 of the developer discharge portion 22*h*. Note that FIGS. 6 and 7 are perspective views showing the outlet 65 of the development device 2 as viewed from below.

As shown in FIG. 8, an inner gear is formed on an inner circumferential surface of the cylindrical portion 71 of the shutter 70. As shown in FIGS. 4 and 8, a drive gear 66 is fixed to an end portion closer to the outlet 65 of the rotating shaft 44*b* of the second spiral 44. The drive gear 66 is engaged with the inner gear of the shutter 70. Therefore, the development device 2 is driven, whereby the second spiral 44 and the drive gear 66 rotate, so that, in association with this, the shutter 70 is driven (rotated). As a result, the outlet 65 of the developer discharge portion 22*h* is opened. Note that the second spiral 44 and the drive gear 66 form a "drive mechanism" according to an example of the present disclosure.

In the development device 2, when the second spiral 44 and the drive gear 66 are driven to rotate, so that the shutter 70 transitions from the state of FIG. 6 to the state of FIG. 7, the shutter 70 is not allowed to rotate further. For example, a contact member (not shown) may be provided in the developer container 22, and a torque limiter (not shown) may be provided in the shutter 70. The contact member strikes or comes into contact with a portion (a protruding portion 72 described below, etc.) of the shutter 70 when the shutter 70 is rotated until the shutter is in the state of FIG. 7. With this configuration, when the shutter 70 is rotated until the shutter is in the state of FIG. 7, the shutter 70 is not allowed to rotate further. In this case, the outlet 65 is allowed to be always open.

The shutter 70 includes the protruding portion 72 which protrudes from the outer circumferential surface of the cylindrical portion 71. A detection sensor 83 is provided in the vicinity of the protruding portion 72. The detection sensor 83 is fixed to the body of the image forming apparatus 1. The detection sensor 83 detects the opening and closing of the outlet 65.

The detection sensor 83 is, for example, an optical sensor. In this case, the detection sensor 83 includes a light emitting unit 83*a* and a light receiving unit 83*b*. The detection sensor 83 is arranged so that the protruding portion 72 of the shutter 70 is allowed to pass between the light emitting unit 83*a* and the light receiving unit 83*b*. When the protruding portion 72 is not located between the light emitting unit 83*a* and the light receiving unit 83*b* (the state of FIG. 6), light S emitted from the light emitting unit 83*a* reaches the light receiving unit 83*b*. On the other hand, when the protruding portion 72 is located between the light emitting unit 83*a* and the light receiving unit 83*b* (the state of FIG. 7), the light S emitted from the light emitting unit 83*a* is blocked by the protruding portion 72 and therefore does not reach the light receiving unit 83*b*. It is possible to detect a rotational angle of the shutter 70 by using the detection sensor 83. Therefore, the open and closed states of the outlet 65 can be detected. For example, in this embodiment, when the light receiving unit 83*b* receives the light S as shown in FIG. 6, the closed state of the outlet 65 is detected. When the light receiving unit 83*b* does not receive the light S as shown in FIG. 7, the open state of the outlet 65 is detected.

The detection sensor 83 is configured to output to a control unit (not shown) a voltage value corresponding to the detection result of the light receiving unit 83*b*. When the detection sensor 83 detects the closed state of the outlet 65 during the development process, the control unit warns the user that the outlet 65 is closed. For example, a warning unit (not shown) capable of warning the user is electrically connected to the control unit. The warning unit may be a display unit, such as a control panel etc., which is configured to display a warning statement to the user. Alternatively, the warning unit may be an alarm sound generator which is configured to makes an alarm sound to the user.

Next, operations of the shutter 70 etc. will be described. As shown in FIG. 6, the shutter 70 closes the outlet 65 when the image forming apparatus 1 is transported (shipped). Therefore, even when the image forming apparatus 1 in which the development device 2 is mounted is transported, the developer loaded in the development device 2 is not likely to leak from the outlet 65 due to vibration, shock, etc. during transportation. This holds true for the case where the development device 2 packed separately from the body of the image forming apparatus 1 is transported (shipped).

When the image forming apparatus 1 is brought to the user and a service man sets up (initializes) the image forming apparatus 1, then the development device 2 starts to be driven and the second spiral 44 is rotated. As a result, the drive gear 66 is rotated, so that the shutter 70 is rotated by a predetermined amount. As a result, the opening 71*a* of the shutter 70 is oriented in a vertically downward direction (towards a lower position), so that the outlet 65 is opened, and the protruding portion 72 strikes or comes into contact with the contact member to stop the rotation of the shutter 70. In this case, the protruding portion 72 is located between the light emitting unit 83*a* and the light receiving unit 83*b*, whereby the detection sensor 83 detects the open state of the outlet 65.

When the outlet 65 is opened, the outlet 65 is in communication with the transport pipe (not shown), to allow the developer to be discharged through the outlet 65. The developer discharged through the outlet 65 is transported through the transport pipe to the collecting container (not shown), in which the developer is then stored.

In this embodiment, as described above, the shutter 70 can open and close the outlet 65 through which excess developer can be discharged from the developer container 22. Therefore, the outlet 65 can be closed by the shutter 70, whereby the developer can be prevented or substantially prevented from leaking through the outlet 65 due to vibration, shock, etc. during transportation. The drive mechanism (the second spiral 44 and the drive gear 66) drives the shutter 70 in association with driving of the mixing/transporting member 42, to open the outlet 65. As a result, the outlet 65 can be prevented or substantially prevented from remaining closed even after the development device has begun to operate. Therefore, the occurrence of a situation that the pressure of the developer increases in the vicinity of the outlet 65 and therefore the second spiral 44 for transporting the developer is locked (malfunction) can be prevented or substantially prevented.

As described above, the second spiral 44 (the mixing/transporting member 42) also serves as a drive mechanism. Therefore, the shutter 70 can be easily driven in association with driving of the mixing/transporting member 42.

As described above, the outlet 65 can be easily opened by the shutter 70 being slid along the outer circumferential surface of the developer discharge portion 22*h*.

As described above, the second spiral 44 (the mixing/transporting member 42), and the drive gear 66 provided at a portion closer to the outlet 65 of the second spiral 44, form a drive mechanism. The inner gear which is engaged with the drive gear 66 is formed on the inner circumferential surface of the shutter 70. As a result, the shutter 70 can be easily driven to slide along the outer circumferential surface of the developer discharge portion 22*h*, about the center axis of the developer discharge portion 22*h*.

As described above, the detection sensor 83 detects the open and closed states of the outlet 65. As a result, if the outlet 65 is in the closed state due to a fault etc. in the drive mechanism, the closed state of the outlet 65 can be detected by the detection sensor 83. Therefore, the occurrence of the situation that the pressure of the developer increases in the vicinity of the outlet 65 and therefore the second spiral 44 for transporting the developer is locked (malfunction) can be reduced or prevented.

As described above, if the closed state of the outlet 65 is detected by the detection sensor 83 during the development process, the user is warned that the outlet 65 is closed. As a result, the user can be notified that the outlet 65 is closed. In addition, the develop process can be prevented or substantially prevented from being performed while the outlet 65 is in the closed state. Therefore, the occurrence of the situation that the pressure of the developer increases in the vicinity of the outlet 65 and therefore the second spiral 44 for transporting the developer is locked (malfunction) can be reduced or prevented.

The embodiment described above is considered to be illustrative in all respects and not restrictive, the scope of the present disclosure being indicated by the appended claims rather than by the foregoing description. The present disclosure includes all modifications and equivalents as defined by the appended claims.

For example, although the tandem color printer of FIG. 1 is illustrated in the above embodiment, the present disclosure is not limited to this. The present disclosure is applicable to various image forming apparatuses including a development device including an opening/closing member for opening and closing a developer outlet, such as a digital or analog monochromatic copy machine, color copy machine, fax machine, etc.

Although, in the above illustrative embodiment, the shutter is driven by the mixing/transporting member and the drive gear, the present disclosure is not limited to this. The shutter may be driven by another drive mechanism instead of the mixing/transporting member and the drive gear.

Although, in the above illustrative embodiment, the shutter is slid and rotated along the outer circumferential surface of the pipe-like transport path, about the center axis of the pipe-like transport path, the present disclosure is not limited to this. The shutter may be slid along the outer circumferential surface of the pipe-like transport path in a direction in which the center axis of the pipe-like transport path extends.

Although, in the above illustrative embodiment, the torque limiter is provided, and the contact member is provided on the developer container, in order to prevent the shutter from rotating by a predetermined angle or more, the present disclosure is not limited to this. The torque limiter and the contact member may be removed. In this case, the shutter continues to rotate, and therefore, the outlet (developer outlet) is repeatedly and alternately brought to the open and closed states. However, the pressure of the developer can be prevented or substantially prevented from increasing to a predetermined value or more in the vicinity of the developer outlet.

Although, in the above illustrative embodiment, the light receiving unit receives light when the outlet is in the closed state as shown in FIG. 6 and does not receive light when the outlet is in the open state as shown in FIG. 7, the present disclosure is not limited to this. The position of the protruding portion or the detection sensor may be changed so that the light receiving unit does not receive light when the outlet is in the closed state and receives light when the outlet is in the open state.

Although the detection sensor is an optical sensor in the above illustrative embodiment, the present disclosure is not limited to this. The detection sensor may be, for example, a magnetic permeability sensor. In this case, the protruding portion may be formed of a magnetic material. A side surface of the cylindrical portion of the shutter may be formed of a magnetic material and a non-magnetic material, and the magnetic permeability sensor may be arranged to face the side surface of the cylindrical portion of the shutter. In this case, the rotational angle of the shutter can be detected based on an output of the magnetic permeability sensor.

Although, in the above illustrative embodiment, the detection sensor is provided in order to detect the open and closed states of the outlet (developer outlet), the detection sensor may not be provided.

Although, in the above illustrative embodiment, the drive mechanism and the shutter are configured to only open the outlet, the present disclosure is not limited to this. The drive mechanism and the shutter may be configured to be able to close the outlet again. This configuration can prevent or substantially prevent the developer from leaking through the outlet when the development device is replaced, the place where the image forming apparatus is installed is changed, etc. Note that, in this case, for example, an outlet close/open button, an image forming apparatus transport button, etc. are suitably provided in a control panel etc. When the user presses these buttons, the drive mechanism and the shutter may be reversely rotated to close the outlet again.

In the above illustrative embodiment, the drive mechanism is configured to drive the opening/closing member in association with driving of the mixing/transporting member. Alternatively, the drive mechanism may be configured to drive the opening/closing member in association with driving of the developer bearing member.

At a peripheral portion of the outlet, a sealing member may be provided between the outer circumferential surface of the developer discharge portion and the inner circumferential surface of the shutter. In this case, the developer can be prevented or substantially prevented from leaking through a gap between the developer discharge portion and the shutter.

What is claimed is:

1. A development device comprising:

a developer container configured to contain a developer;

a developer bearing member configured to be rotatably supported by the developer container, have a surface facing an image bearing member on which an electrostatic latent image is to be formed, and bear the developer on the surface;

a mixing/transporting member configured to mix and transport the developer in the developer container;

an opening/closing member configured to open and close a developer outlet for discharging an excess of the developer in the developer container;

a pipe-like transport path provided in the developer container and configured to transport the developer and have an outer circumferential surface in which the developer outlet is formed; and a drive mechanism configured to drive the opening/closing member in association with driving of the mixing/transporting member to open the developer outlet by sliding the opening/closing member along the outer circumferential surface of the pipe-like transport path about a center axis of the pipe-like transport path, wherein the mixing/transporting member also serves as the drive mechanism, the opening/closing member has an opening, before the opening/closing member is driven, the opening does not overlap with the developer outlet and the opening/closing member is in a state closing the developer outlet, when the opening/closing member slides along the outer circumferential surface of the pipe-like transport path such that the opening overlaps with the developer outlet, the opening/closing member transitions from the state closing the developer outlet to a state opening the developer outlet, once the opening overlaps with the developer outlet, the opening/closing member stops and then is not driven in association with driving of the mixing/transporting member to be kept in the state opening the developer outlet.

2. The development device of claim 1, further comprising:

a drive gear provided on the mixing/transporting member, wherein the opening/closing member has an inner circumferential surface on which an inner gear engaged with the drive gear is provided, and the mixing/transporting member and the drive gear form the drive mechanism.

3. The development device of claim 1, further comprising:

a detection sensor configured to detect an open state and a closed state of the developer outlet.

4. The development device of claim 3, wherein the detection sensor is an optical sensor.

5. The development device of claim 3, wherein at least a portion of the opening/closing member is formed of a magnetic material, and the detection sensor is a magnetic permeability sensor.

6. The development device of claim 1, further comprising:

a deceleration transport portion provided in the developer container and configured to decrease a transport rate of the developer transported by the mixing/transporting member.

7. The development device of claim 6, further comprising:

a regulation portion provided in the developer container and located downstream of the deceleration transport portion in a direction in which the developer is transported, and configured to block the developer transported from the deceleration transport portion and transport, to the developer outlet, the developer in excess of a predetermined amount.

8. The development device of claim 7, wherein the mixing/transporting member includes a helical blade that extends in a same direction as a direction in which the center axis of the pipe-like transport path extends, the deceleration transport portion includes a helical blade wound in a same direction as the helical blade of the mixing/transporting member, the helical blade of the deceleration transport portion is located downstream of the helical blade of the mixing/transporting member in the direction in which the developer is transported, a pitch of the helical blade of the deceleration transport portion is smaller than a pitch of the helical blade of the mixing/transporting member, the regulation portion includes a helical blade wound in an opposite direction to a direction in which the mixing/transporting member is wound, and a pitch of the helical blade of the regulation portion is smaller than the pitch of the helical blade of the mixing/transporting member.

9. An image forming apparatus comprising:

the development device of claim 1.

10. The image forming apparatus of claim 9, further comprising:

a detection sensor configured to detect an open state and a closed state of the developer outlet; and a warning unit configured to warn that the developer outlet is closed, when the detection sensor detects the closed state of the developer outlet during a development process.

* * * * *